US006580666B2

(12) United States Patent
Yamaya

(10) Patent No.: US 6,580,666 B2
(45) Date of Patent: Jun. 17, 2003

(54) ELECTRONIC TIMEPIECE AND METHOD OF DRIVING THE ELECTRONIC TIMEPIECE

(75) Inventor: Daisuke Yamaya, Chiba (JP)

(73) Assignee: Seiko Instruments Inc. (JP)

( * ) Notice: Subject to any disclaimer, the term of this patent is extended or adjusted under 35 U.S.C. 154(b) by 278 days.

(21) Appl. No.: 09/760,044

(22) Filed: Jan. 12, 2001

(65) Prior Publication Data

US 2001/0012242 A1 Aug. 9, 2001

(30) Foreign Application Priority Data

Jan. 27, 2000 (JP) ..... 2000-019222

(51) Int. Cl.[7] ..... G04B 19/04; G04B 19/06; G04B 25/00

(52) U.S. Cl. ..... 368/80; 368/223

(58) Field of Search ..... 368/76, 80, 223, 368/228, 232

(56) References Cited

U.S. PATENT DOCUMENTS 5,222,053 A * 6/1993 Ohhira ..... 368/73
5,251,190 A * 10/1993 Miyasaka et al. ..... 368/10
5,339,293 A * 8/1994 Kamiyama et al. ..... 368/21
5,440,527 A * 8/1995 Okamoto ..... 368/80
6,327,226 B1 * 12/2001 Russi ..... 368/228

* cited by examiner

*Primary Examiner*—Vit Miska
(74) *Attorney, Agent, or Firm*—Adams & Wilks

(57) ABSTRACT

An electronic timepiece has an operating member supported to undergo reciprocal movement and a drive mechanism for driving the operating member to undergo reciprocal movement. A restricting mechanism for restricting movement of the operating member in a preselected moving range. A controller controls the drive mechanism to correct a shift in the preselected moving range of the operating member.

10 Claims, 6 Drawing Sheets

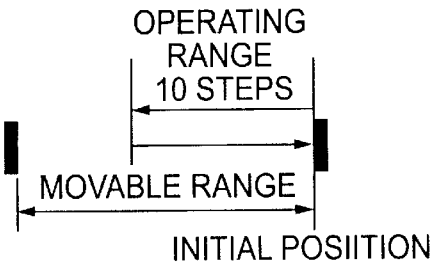
FIG.6A
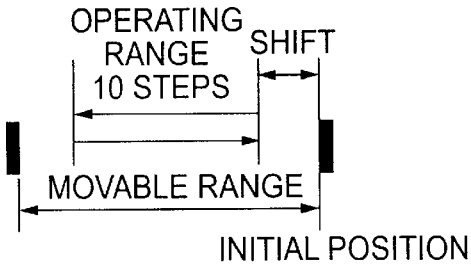
FIG.6B
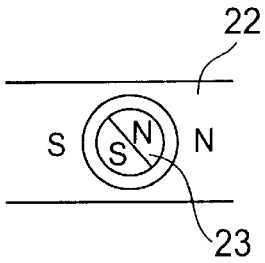
FIG.7A
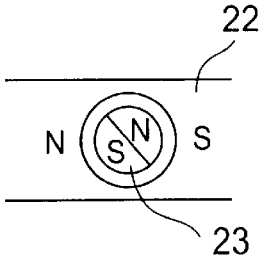
FIG.7B
FIG.8A
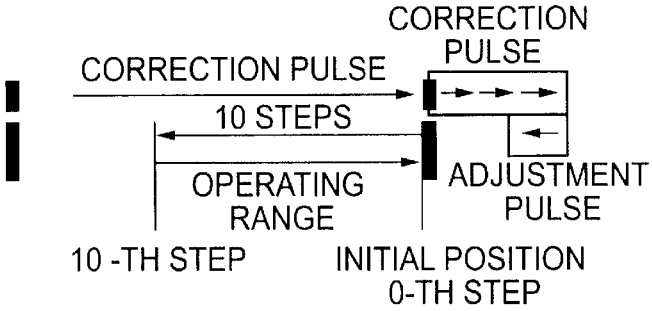
FIG.8B
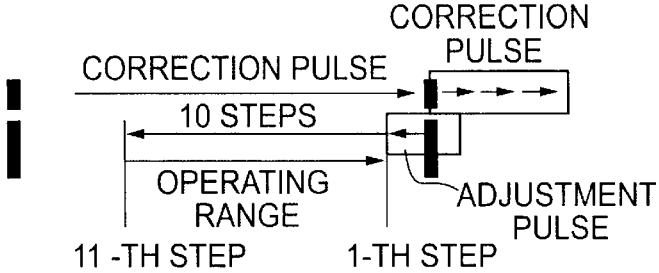

ELECTRONIC TIMEPIECE AND METHOD OF DRIVING THE ELECTRONIC TIMEPIECE

BACKGROUND OF THE INVENTION

1. Field of the Invention

The present invention relates to an electronic timepiece, particularly to an electronic timepiece having a mechanism for reciprocating an indicator or the like using a step motor.

2. Background Information

Generally, according to an electronic timepiece mounted with a microcomputer, it is necessary to make an initial operating position of an IC logic circuit coincide with an initial portion of an indicator. As a position detecting mechanism therefore, there is provided a mechanism of a contact point system, a light detecting system, a pin system or the like.

In this case, the contact point system is a system of detecting a position by detecting a contact state between a portion of a gear for driving an indicator and a contact point portion normally brought into contact with the gear. Further, the light detecting system is a system of optically detecting an angular position of a gear or the like. As a conventional technology of the light detecting system, there is provided a technology disclosed in, for example, Japanese Patent Laid-Open No. 179058/1996.

The pin system is a system for realizing accurate positioning by bringing an indicator into contact with a pin for positioning. As a conventional technology of the pin system, there is provided a technology disclosed in, for example, Japanese Patent Laid-Open No. 291591/1987.

Meanwhile, according to a timepiece, there have been carried out not only pursuit of function as a time counting apparatus but also a devise of achieving a discrimination from other timepiece and promoting a value of a commercial product by adding a design as an ornamental article and a toy-like play feature. Particularly, at a current state realizing sufficiently high accuracy formation, price and added value constitute significant factors for a timepiece as a commercial product and there have been carried out various devises more than those at previous time. As an example of such a timepiece, there is known a constitution in which an indicator which has simply been rotated, is reciprocated in a predetermined range.

However, in the case of the example, when a hand is reciprocated only in a certain range, according to a conventional hand position detecting mechanism, there poses a problem of deteriorating durability, increasing cost, deteriorating detecting accuracy or increasing power consumption. Further, there poses a problem in which a troublesome operation of operation for correcting a positional shift (for example, operation of a winding crown) is requested to a user.

SUMMARY OF THE INVENTION

It is an object of the invention to provide an electronic timepiece capable of reciprocating a special indicator in a predetermined range, which is an electronic timepiece capable of correcting the reciprocating range without increasing the cost.

The invention has been carried out in order to achieve the above-described object and according to a first aspect of the invention, there is provided an electronic timepiece characterized in comprising an operating member supported in a reciprocatable state, a drive mechanism constituted by including a step motor to move the operating member by a respective predetermined amount in a desired regular or reverse direction in accordance with pulses inputted to the step motor, a restricting mechanism to mechanically restrict a range capable of moving the operating member (hereinafter, referred to as "movable range"), and controlling circuit to carry out a processing of reciprocating the operating member in a predetermined range and a correcting processing for correcting a shift in the range of reciprocating the operating member by inputting the pulses to the step motor, wherein in carrying out the correcting processing by the controlling circuit, the operating member is made to reach a distal end position of the movable range by inputting predetermined ones of the pulses to the step motor and thereafter, the number of pulses for moving the operating member in a direction of separating from the distal end position are inputted to the step motor.

Further, according to a second aspect of the invention, there is provided the electronic timepiece, characterized in that the number of the pulses inputted to the step motor to make the operating member reach the distal end position of the movable range, is a number by which an amount of moving the operating member becomes longer than the movable range.

Further, according to a third aspect of the invention, there is provided the electronic timepiece, characterized in that the controlling circuit carries out the correcting processing at predetermined intervals.

Further, according to a fourth aspect of the invention, there is provided the electronic timepiece, characterized in that the interval is prescribed based on time.

An explanation will be given of operation by the above-described aspects of the invention as follows. The operating member is supported in a reciprocatable state. However, the movable range is restricted by the restricting mechanism. Normally, the controlling circuit reciprocates the operating member in the predetermined range by inputting pulses to the step motor of the drive mechanism.

Further, the controlling circuit carries out the correcting processing for correcting the shift in the reciprocating range pertinently (for example, at predetermined intervals determined based on time or the like). The correcting processing is carried out by operating the operating member as follows by inputting the pulses to the step motor. That is, firstly, the operating member is made to reach the distal end position of the movable range. Thereafter, the operating member is moved in the direction of separating from the distal end position.

In this case, it is preferable that the number of the pulses inputted for making the operating member reach the distal end position of the movable range is the number by which the amount of moving the operating member in calculation is made to be longer than a width of the movable range.

BRIEF DESCRIPTION OF THE DRAWINGS

A preferred form of the present invention is illustrated in the accompanying drawings in which:

FIG. 6 illustrate views indicating a positional relationship between a movable range and an operating range in which FIG. 6A is a view showing a state in which the operating range is disposed at an inherent position and FIG. 6B is a view showing a state in which a shift is caused in the operating range;

FIG. 7 illustrate views showing states of a step motor in a state in which an indicator is disposed at an initial position in which FIG. 7A is a state of producing rotational force and FIG. 7B shows a state of not producing the rotational force;

FIG. 8 illustrate views showing roles of a correction pulse and an adjustment pulse in correcting operating in which FIG. 8A is a view showing a case in which the indicator is not moved by the adjustment pulse and FIG. 8B is a view showing a case in which the indicator is moved by the adjustment pulse.

DETAILED DESCRIPTION OF THE PREFERRED EMBODIMENTS

A detailed explanation will be given of embodiments of an electronic timepiece according to the invention in reference to the drawings as follows. Further, the invention is not limited by the embodiments.

The electronic timepiece of the embodiment is featured in being provided with an indicator repeating reciprocatable movement in a predetermined range and provided with a function of automatically correcting a shift in the range of the reciprocatable movement when the range is shifted by some cause. First, an explanation will be given of an outline of a timepiece 10 according to the embodiment.

Figure 1:
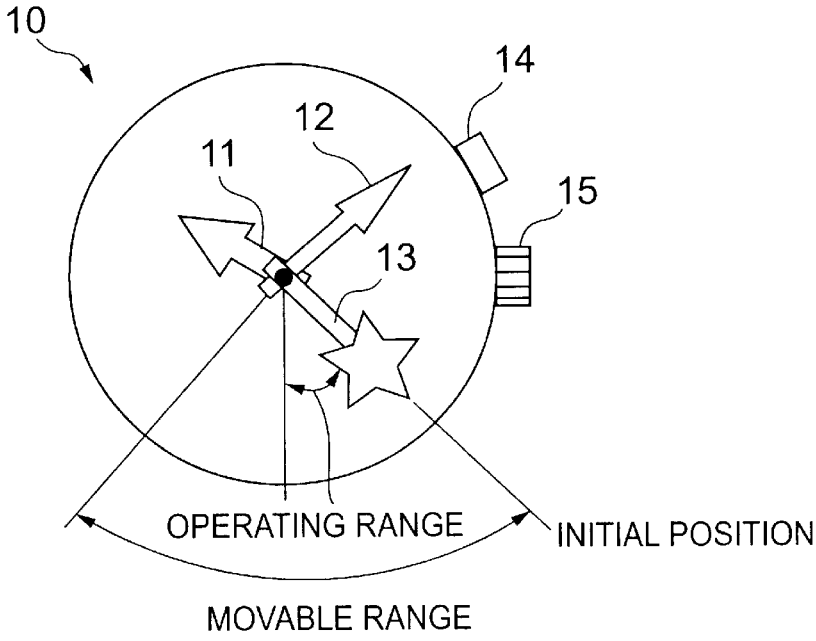
FIG. 1 is a schematic front view showing an outline of an electronic timepiece according to an embodiment of the invention.

As shown by FIG. 1, the timepiece 10 is provided with an hour hand 11, a minute hand 12 and an indicator 13. Further, there are provided a push switch 14 and a winding crown 15 as an operating portion for correcting positions of these or the like. The hour hand 11 and the minute hand 12 are for indicating time and are constituted to rotate by one rotation at every 12 hours and every hour, respectively. With regard to the hour hand 11 and the minute hand 12, hand positions thereof are constituted to be able to correct to desired positions by operating the winding crown 15 by the user.

The indicator 13 is provided mainly for ornamental purpose, or in this case, particularly as an added value in a toy-like sense and in a normal state, the indicator 13 is constituted to repeat reciprocatable movement in an inherent operating range (operating range when an initial position thereof constitutes an onset point). Therefore, the indicator 13 does not display time but is an element especially provided for such above-described operation.

In the normal state, the indicator 13 carries out the reciprocatable movement only in the inherent operating range, mentioned above. However, in view of its mechanism, the indicator 13 can reach a region exceeding the operating range so far as the operating range falls in a movable range illustrated in the drawing. Therefore, when the timepiece 10 receives impact, or the like, there is a case in which the operating range is shifted from the inherent position. Hence, the timepiece 10 is provided with a correcting function for correcting the operating range. As mentioned above, the correcting function constitutes the maximum characteristic point of the embodiment and accordingly, hereinafter, an explanation will be given centering on the point.

Figure 4:
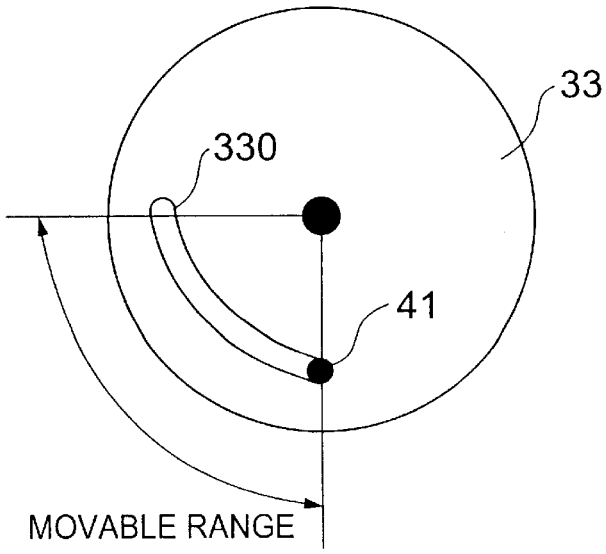
FIG. 4 is a view showing a relationship between a window portion of an intermediate wheel and a movable range.
Figure 2:
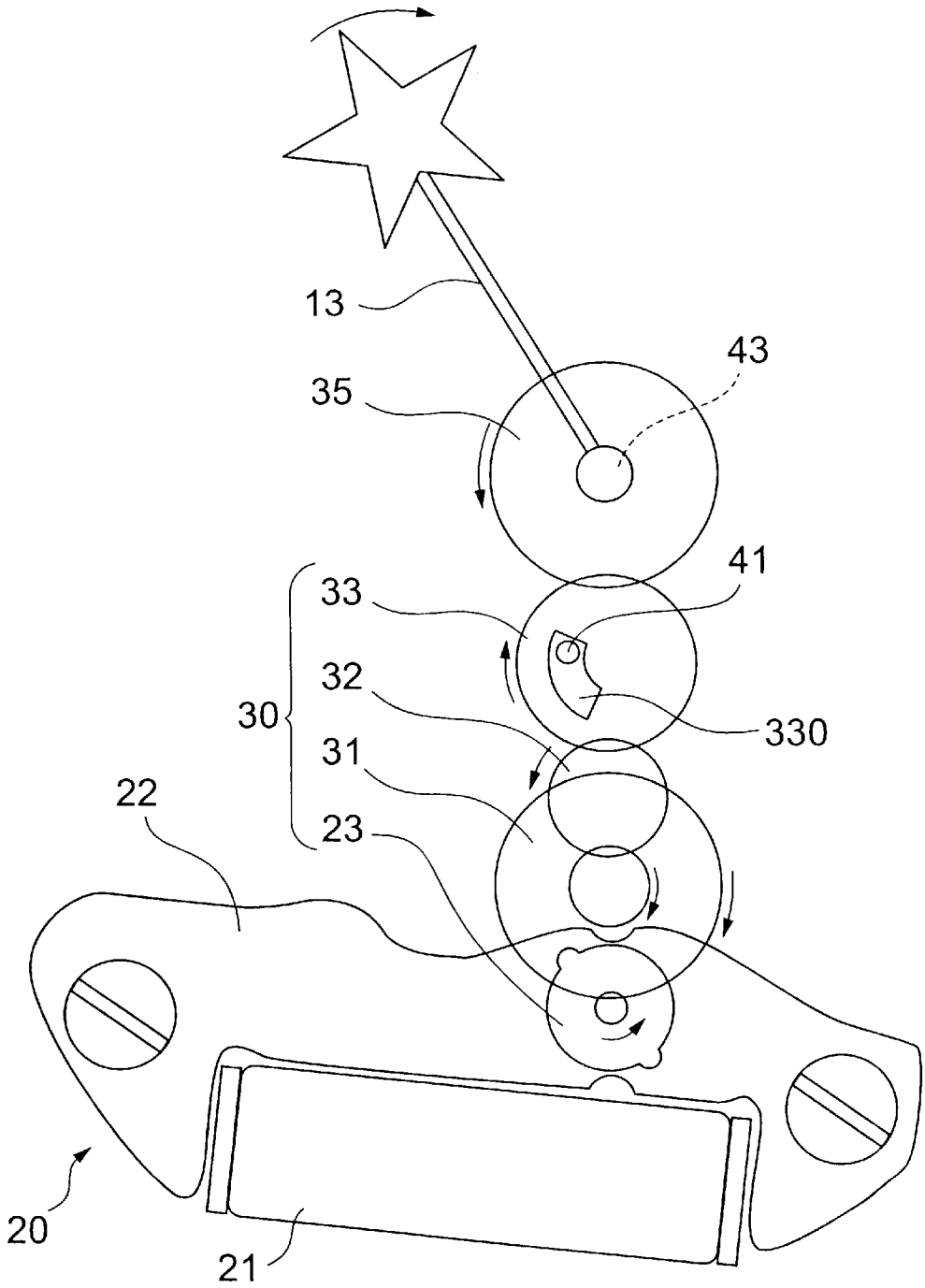
FIG. 2 is a schematic plane view showing essential portions of a mechanism of the electronic timepiece.
Figure 3:
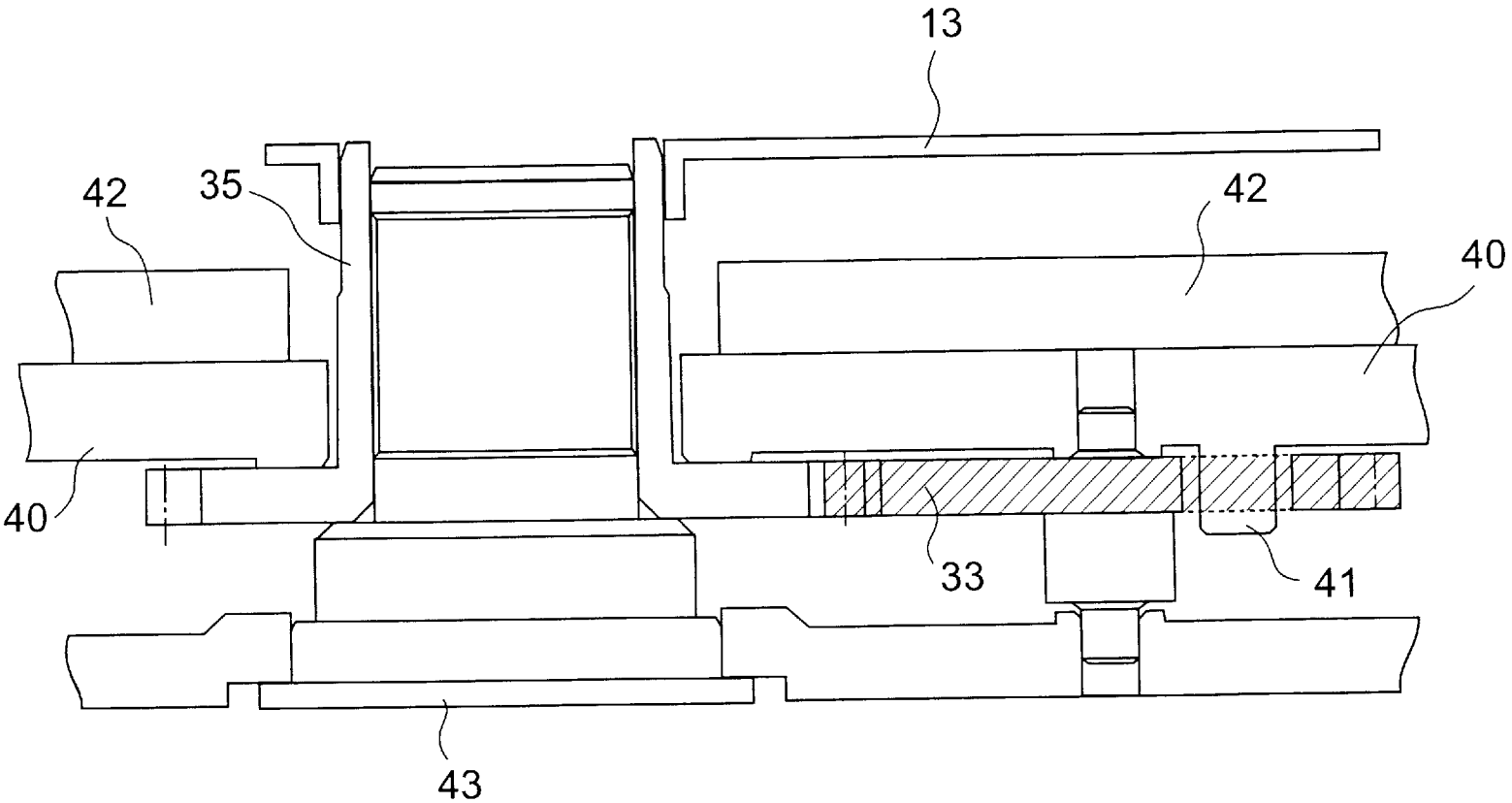
FIG. 3 is a schematic sectional view showing essential portions of the mechanism of the electronic timepiece.

An explanation will be given of essential portions of the mechanism of the timepiece 10 in reference to FIGS. 2, 3 and 4. According to the indicator 13, an end portion on a root side thereof (end portion on a lower side in FIG. 2) is fixed to a display wheel 35. Further, the display wheel 35 is supported by a rotational center shaft 43 in a rotatable state. Further, the display wheel 35 (that is, the indicator 13) is constituted to be transmitted with rotational force of a step motor 20 via a train wheel 30.

The train wheel 30 is constituted to include a fifth wheel & train 31, an intermediate wheel A 32 and an intermediate wheel B 33. Among them, the intermediate wheel B 33 is formed with a window portion 330. Further, as shown by FIG. 3, the window portion 330 is penetrated with a pin 41 fixed to a main plate 40 and the constitution restricts a rotatable range of the intermediate wheel B 33. That is, the intermediate wheel B 33 is constituted such that an angular position thereof can be changed only in a range in which the pin 41 is not brought into contact with distal end edge portions of the window portion 33. As shown by FIG. 4, the movable range of the indicator 13, mentioned above, is rectified by a size of the window portion 330 and a position of forming thereof.

By constructing such a constitution, according to the indicator 13, the angular position is restricted in the movable range. Further, the indicator 13 carries out the reciprocatable movement within the operating range which is further set in the movable range. The operating range is determined depending on content of operational instruction (pulse) from a control unit 50, mentioned later.

Figure 5:
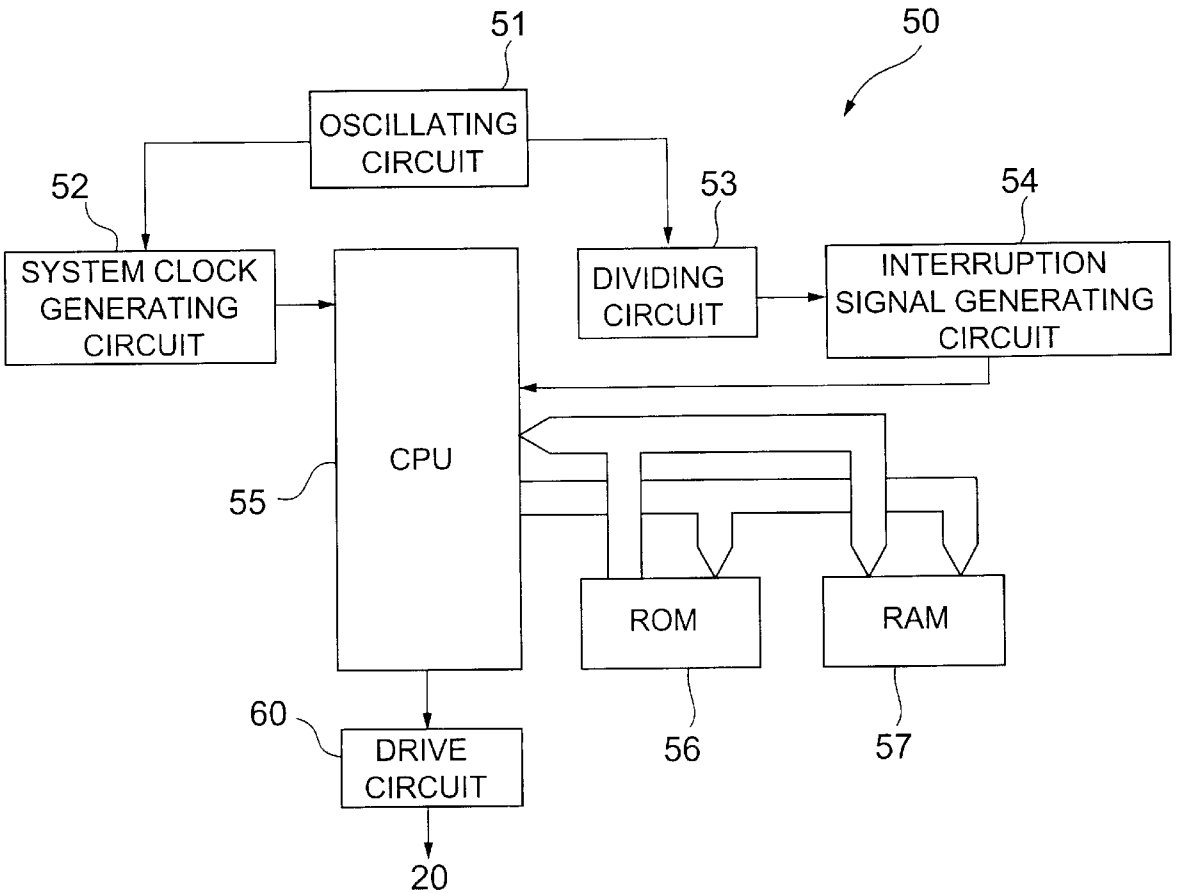
FIG. 5 is a diagram showing a control constitution of the electronic timepiece.

Next, an explanation will be given of a control constitution for operating the indicator 13 in reference to FIG. 5. The control unit 50 for governing to drive the indicator 13 is constituted to be provided with an oscillating circuit 51, a system clock generating circuit 52, a dividing circuit 53, an interruption signal generating circuit 54, CPU 55, ROM 56, RAM 57 and a drive circuit 60.

The oscillating circuit 51 generates an oscillating signal having a predetermined frequency constituting a basis of operational timings of the timepiece 10. The oscillating circuit 51 is constituted to output the oscillating signal to the system clock generating circuit 52 and the dividing circuit 53.

The interruption signal generating circuit 54 generates a system clock based on the oscillating signal inputted from the oscillating circuit 51. The interruption signal generating circuit 54 is constituted to output the system clock to CPU 55.

The dividing circuit 53 generates a clock having a predetermined cycle by dividing the oscillating signal inputted from the oscillating circuit 51. The clock is outputted to the interruption signal generating circuit 54. The clock is used for determining timings of starting various operations or the like. The dividing circuit 53 is constituted to output the clock to the interruption signal generating circuit 54.

The interruption signal generating circuit 54 is for detecting a timing of starting an operation of correcting the operating range of the indicator 13. Specifically, the timing is detected by counting the clock from the dividing circuit 53. The embodiment is constituted to output an interruption signal for instructing to start the correcting operation at every 20 minutes (every 60 reciprocations, 1 step=1 second).

CPU 55 is for governing to control a total of the timepiece 10 and realizes various functions by executing programs in synchronism with the system clock. For example, when the interruption signal is inputted from the interruption signal generating circuit 54 there is provided a function of carrying out an operation of correcting the operating range via the drive circuit 60. Further, control programs, various data and the like for prescribing the content of the correcting operation are previously stored in ROM 56 and RAM 57.

Various pulses for operating the step motor 20 are outputted from the control unit 50 (directly, from drive the circuit 60). The embodiment is constituted to be able to output regular rotation pulses, reverse rotation pulses, correction pulses and adjustment pulses. In this case, the "regulation rotation pulse" is a pulse for moving the indicator 13 in a regular rotation direction (direction separating from an initial position) by 1 step. The "reverse rotation pulse" is a pulse for moving the indicator 13 in a reverse rotation direction (direction approaching initial position) by 1 step. However, as mentioned later, depending on a state of the step motor 20, there is a case in which the indicator 13 cannot be moved (that is, the step motor 20 is not rotated).

The "correction pulse" is outputted for forcibly returning the indicator 13 to the initial position in correcting the operating range of the indicator 13. The correction pulse is constituted by the reverse rotation pulse and in order to be able to move the indicator 13 firmly to the initial position, a number of generating thereof is a number by which a movable range as a whole (in calculation) becomes longer than a length of the movable range.

The "adjustment pulse" is for adjusting a state of the step motor 20 (specifically, a positional relationship between magnetic poles of a stator 22 and a rotor 23) in adjusting the operating range. Specifically, the adjustment pulse is constituted by a single of the regular rotation pulse and is outputted successive to the correction pulse in the processing of correcting the operating range of the indicator 13. Further, with regard to roles of the pulses or the like, a detailed explanation will be given later in reference to FIGS. 7 and 8.

Further, the regular rotation direction, mentioned here, is a direction directed to the left (direction separating from the initial position) in FIGS. 6 and 8, described later. The reverse rotation direction is a direction directed to the right (direction returning to the initial position) in these drawings.

The "operating member" stated in the Scope of Claims corresponds to the indicator 13 according to the embodiment. The "step motor" corresponds to the step motor 20. The "drive mechanism" is constituted by the train wheel 30, the step motor 20 and the like. The "regulating mechanism" is realized by the intermediate wheel B 33 (especially, the window portions 330) and the pin 41. The "controlling means" corresponds to the control unit 50. The "correcting processing" corresponds to the processing of correcting the operating range. The "distal end position of the movable range" to which the operating member reaches in the correcting processing, corresponds to the initial position. The "pulse inputted for making the operating member reach the distal end position of the movable range" corresponds to the correction pulse. The "pulse for moving the operating member in a direction of separating from the distal end position" corresponds to the adjustment pulse.

Next, an explanation will be given of the correcting operation of the indicator 13 in reference to FIGS. 6, 7 and 8. Here, it is assumed that the operating range of the indicator 13 to be inherently brought into a state shown by FIG. 6A is already shifted and is brought into a state of FIG. 6B. Even in the state, (FIG. 6B), the control unit 50 alternately outputs tens of the regular rotation pulses and the reverse rotation pulses. That is, the indicator 13 is reciprocated in a current operating range (FIG. 6B).

Under the state, the control unit 50 starts the correcting operation of the operating range at a predetermined timing. According to the correcting operation, firstly, the control unit 50 outputs the correction pulses. By the correction pulses, the indicator 13 is forcibly returned to the initial position. Further, although even after the indicator 13 reaches the initial position, remaining portions of the correction pulses continue outputting, the indicator 13 is not moved further.

Meanwhile, during a time period at and after a time point at which the indicator 13 returns to the initial position and until the correction pulses terminate, the step motor 20 is alternately brought into two different states (FIG. 7A, FIG. 7B). A first state is a case in which the positional relationship between the magnetic pole of the rotor 23 and the magnetic pole produced in the stator 22 by a pulse inputted at that time is brought into a state shown by FIG. 7A. In this case, the magnetic poles having the same polarities of the stator 22 and the rotor 23 are opposed to each other and accordingly, there is generated a force for rotating the rotor 23. However, the indicator 13 has already returned to the initial position and accordingly, the rotor 23 cannot be rotated. As a result, even at the time point at which the pulse finishes outputting, the rotor 23 stays to be directed as shown by the drawing.

A second state is a case in which the positional relationship between the magnetic pole of the rotor 23 and the magnetic pole produced in the stator 22 by a pulse inputted at that time is brought into a state shown by FIG. 7B. In this case, the magnetic poles having different polarities of the stator 22 and the rotor 23 are opposed to each other and attract each other. Therefore, at this occasion, the force for rotating the rotor 23 is not generated from the start. As a result, even at the time point at which the pulse finishes outputting, the rotor 23 stays to be directed as shown by the drawing.

In driving the step motor 20, a direction of conducting electricity to the stator 22 is reversed at respective step as is well known. Therefore, the state of the step motor 20 at that time point at which the correction pulse finishes outputting, is either of the states of FIGS. 7A and 7B.

After finishing to output the correction pulse, the control unit 50 outputs the adjustment pulse (that is, a single regular rotation pulse). When the positional relationship between the magnetic pole produced in the stator 22 by the adjustment pulse and the magnetic pole of the rotor 23 is similar to that in FIG. 7B, the indicator 13 is not moved in the regular rotation direction by inputting the adjustment pulse (refer to FIG. 8A). After finishing the correcting operation, when the regular rotation pulse is inputted for operating the indicator 13, a state similar to that in FIG. 7A is produced and therefore, the indicator 13 is moved in the regular rotation direction necessarily from the first pulse. Therefore, the operating range of the indicator 13 becomes a position between a position (initial position) at 0-th step through a position at 10-th step.

Meanwhile, when the positional relationship between the magnetic pole produced at the stator 22 by the adjustment pulse and the magnetic pole of the rotor 23 is similar to that in FIG. 7A, the indicator 13 is moved in the regular rotation direction by 1 step by inputting the adjustment pulse (refer to FIG. 8B). Further, after finishing the correcting operation, when the regular rotation pulse is inputted for operating the indicator 13, the indicator 13 is moved in the regular rotation direction necessarily from the first pulse. Therefore, the operating range at the indicator 13 becomes a position at 1-th step through a position at 11-th. Although there is a possibility in which the shift in the operating range slightly remains (1 step) in this way, considerable shift can firmly be resolved.

Figure 9:
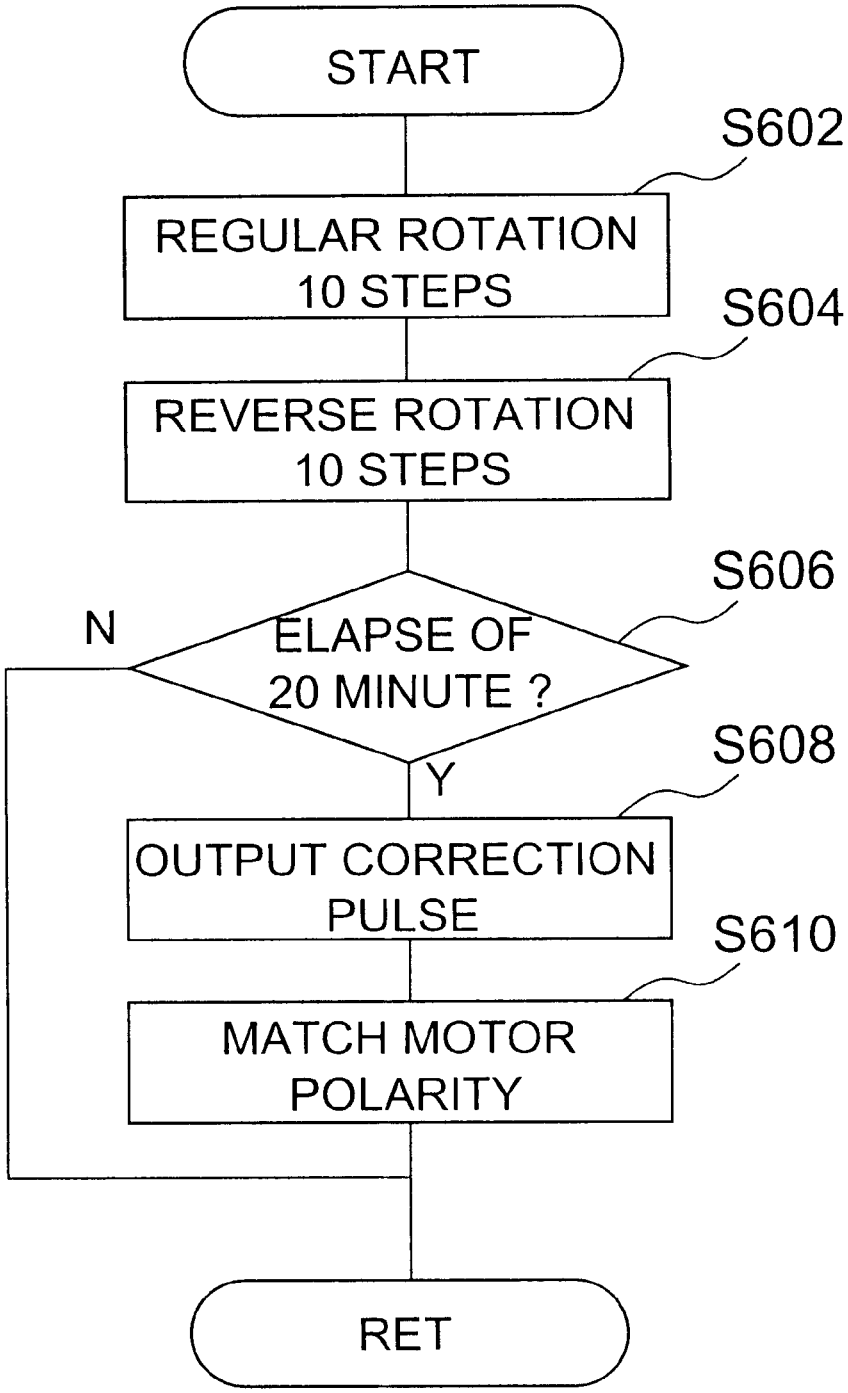
FIG. 9 is a flowchart showing a processing of the correcting operation by a control unit.

Next, an explanation will be given of operation control of the indicator 13 by the control unit 50 in reference to FIG. 9. The control unit 50 repeats processings shown in FIG. 9 always in operating the timepiece 10. Normally, the control unit 50 moves the indicator 13 by 10 steps in the regular rotation direction by outputting the regular rotation pulses (step S602) at predetermined timings. Successively, the indicator 13 is moved by 10 steps in the reverse rotation direction by outputting the reverse rotation pulses (step S604).

Next, the control unit 50 determines whether the current time is a timing of carrying out the correcting operation of the operating range (step S606). Actually, the determination is carried out by determining presence or absence of an interruption signal from the interruption signal generating circuit 54 by CPU 55. When the current time is not the timing of carrying out the correcting operation as a result of the determination, the processing is finished as it is.

Meanwhile, at step S606, when the current time is the timing of carrying out the correcting operation, the correcting operation (steps S608, S610) is carried out. That is, firstly, CPU 55 swiftly returns the indicator 13 to the initial position by outputting the correction pulse of the step motor 20 via the drive circuit 60 (step S608).

Successively, the control unit 50 outputs the adjustment pulse. Thereby, when the regular rotation pulse is outputted at a next time, the rotational force is produced in the step motor 20. That is, when the processing of FIG. 9 is executed at the next time, the indicator 13 is firmly moved from the first regular rotation pulse at step S602. Thereby, as the width of the operating range of the indicator 13, 10 steps are firmly ensured.

Further, when the adjustment pulse is not inputted as in the embodiment, at the next time, there is a case in which the indicator 13 is not moved by the first regular rotation pulse at step S602. In this case, even at a time point at which step S602 is finished, the indicator 13 can reach only a 9-th step from the initial position. As a result, the width of the operating range of the indicator 13 becomes that of 9 steps.

Next, an explanation will be given of operation at inside of the control unit 50 in reference to FIG. 5. The oscillating circuit 51 always generates the oscillating signal at the predetermined frequency and outputs the oscillating signal to the system clock generating circuit 52 and the dividing circuit 53. The interruption signal generating circuit 54 generates the system clock based on the oscillating signal and outputs the system clock to CPU 55.

Meanwhile, the dividing circuit 53 generates the clock having a desired cycle by dividing the oscillating signal and outputs the clock to the interruption signal generating circuit 54. The interruption signal generating circuit 54 detects a predetermined timing by counting the clocks and outputs the interruption signal to CPU 55. CPU 55 starts the correcting processing of the operating range when the interruption signal is inputted.

The control unit 50 executes a similar correcting processing of the operating range even when the push switch 14 is operated although not particularly mentioned in the above-described explanation.

As has been explained, according to the embodiment, correction of the operating range is carried out at every predetermined time. Therefore, it is not necessary that the user per se carries out the correcting operation. Further, the correcting operation can be realized by only changing software and accordingly, it is not necessary to add new parts or the like.

Further, according to the above-described embodiment, the operating range in the normal state is set by setting the distal end position of the movable range (initial position) as the onset point. However, the position of setting the operating range is not limited thereto. The position can be set to a desired position by constituting the above-described adjusting pulses by a plurality of the regular rotation pulses.

Further, although according to the above-described embodiment, the timing of carrying out the correcting operation is determined based on elapse time, the timing may be determined based on a factor other than thereof. For example, the timing of execution can also be determined based on a number of times of receiving impact or the like.

Further, the applicable range of the invention is not limited to the indicator. Other than thereof, the invention is applicable also to power reserve, date display, chronograph, timer or the like.

As has been explained, according to the invention, the operating range of the reciprocating member (indicator) can be corrected without increasing the cost.

The correcting processing by the controlling means can make the reciprocating member firmly reach the distal end position of the movable range by making the operating member reach the distal end position of the movable range by inputting predetermined pulses to the step motor and thereafter inputting pulses for moving the operating member in the direction of separating from the distal end position to the step motor.

Further, a number of pulses inputted for making the operating member reach the distal end position of the movable range is the number by which the amount of moving the operating member becomes longer than the movable range, thereby, the reciprocating member can firmly reach the distal end position of the movable range and even when the initial position is shifted, the initial position can be adjusted to set and the shift in the movable range can be corrected.

Further, the controlling means carries out the correcting processing at predetermined intervals, thereby, the initial position can periodically be corrected and can be carried out without applying burden on the user.

Further, interval is prescribed based on time, thereby, the interval capable of correcting the initial position periodically can freely be set and the pertinent interval can be set in accordance with the electronic timepiece used.

What is claimed is:

1. An electronic timepiece comprising:

an operating member supported to undergo reciprocal movement;

a driving means for driving the operating member to undergo reciprocal movement;

a restricting mechanism for restricting movement of the operating member in a preselected moving range; and a control means for controlling the driving means to correct a shift in the preselected moving range of the operating member.

2. An electronic timepiece according to claim 1; wherein the driving means comprises a step motor.

3. A method of driving an electronic timepiece, comprising the steps of:

driving an operating member to undergo reciprocal movement in a preselected moving range; and correcting a shift in the preselected moving range of the operating member.

4. A method of driving an electronic timepiece according to claim 3, wherein the correcting step comprises inputting drive pulses to a step motor to move the operating member to a distal end position of the preselected moving range, and inputting drive pulses to the stepping motor to move the operating member away from the distal end position of the preselected moving range.

5. A method of driving an electronic timepiece according to claim 4, wherein the number of drive pulses required to move the operating member to the distal end position is larger than the number of drive pulses required to move the operating member in the preselected moving range.

6. A method of driving an electronic timepiece according to claim 3, wherein the correcting step is performed at predetermined intervals.

7. An electronic timepiece compriseing:

an operating member supported to undergo reciprocal movement;

driving means for driving the operating member to undergo reciprocal movement;

a restricting mechanism for restricting movement of the operating member in a preselected moving range; and control means for controlling the driving means to correct a shift in the preselected moving range of the operating member.

8. An electronic timepiece according to claim 7; wherein the control means comprises an oscillating circuit for generating an oscillating signal, a dividing circuit for dividing the oscillating signal from the oscillating circuit, an interruption signal generating circuit for detecting a shift in the preselected moving range of the operating member, and a drive circuit for driving the driving mean to correct the detected shift in the the preselected moving range of the operating member in accordance with an interruption signal outputted from the interruption signal generating circuit.

9. An electronic timepiece according to claim 8; wherein the driving means comprises a step motor; and wherein the drive circuit outputs drive pulses for driving the step motor to drive the operating member to thereby correct a shift in the preselected moving range.

10. An electronic timepiece according to claim 8; wherein the driving means comprises a step motor and a train wheel for transmitting a driving force of the step motor to the operating member.

* * * * *